US008893890B2

(12) United States Patent
Berger et al.

(10) Patent No.: US 8,893,890 B2
(45) Date of Patent: Nov. 25, 2014

(54) REFILLABLE CONTAINER

(71) Applicant: Kimberly-Clark Worldwide, Inc., Neenah, WI (US)

(72) Inventors: Maggie VanderHeiden Berger, Appleton, WI (US); Kevin Christopher Possell, Middleton, WI (US); Jason Robert Boon, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 1 day.

(21) Appl. No.: 13/773,297

(22) Filed: Feb. 21, 2013

(65) Prior Publication Data

US 2014/0231297 A1 Aug. 21, 2014

(51) Int. Cl.
*B65D 85/00* (2006.01)

(52) U.S. Cl.
CPC ..... *B65D 85/70* (2013.01)
USPC ..... 206/494; 206/581; 220/23.87; 220/200

(58) Field of Classification Search
USPC ..... 206/233, 449, 494, 581; 132/293, 294, 132/300, 314; 220/23.87, 23.89, 200, 810
See application file for complete search history.

(56) References Cited

U.S. PATENT DOCUMENTS 3,013,691 A * 12/1961 Prentice ..... 220/23.89
3,151,771 A * 10/1964 Greene ..... 206/449
3,795,355 A * 3/1974 Gerstein ..... 206/494
4,348,421 A * 9/1982 Sakakibara et al. ..... 220/23.87
4,735,317 A * 4/1988 Sussman et al. ..... 206/449
5,765,715 A * 6/1998 Hughes ..... 220/23.89
5,950,639 A * 9/1999 Suzuki et al. ..... 132/294
6,006,937 A 12/1999 Baravaglio et al.
6,047,710 A 4/2000 Irving et al.
6,129,089 A * 10/2000 Yuhara ..... 132/300
6,138,686 A * 10/2000 Yuhara ..... 132/294
D478,513 S 8/2003 Canamasas Puigbo
D480,307 S 10/2003 Canamasas Puigbo
D493,721 S 8/2004 Puigbo
D499,648 S 12/2004 Lewis et al.
D530,208 S 10/2006 Danne et al.
7,314,051 B2 * 1/2008 Yuhara et al. ..... 132/294
7,322,478 B2 * 1/2008 Goto et al. ..... 206/581
D561,943 S 2/2008 Desdoigts
7,451,877 B2 * 11/2008 Koga et al. ..... 206/581
D588,916 S 3/2009 Demarco
D588,925 S 3/2009 Demarco
7,537,137 B2 5/2009 Giraud
D601,022 S 9/2009 Zamberlan et al.

(Continued)

FOREIGN PATENT DOCUMENTS

DE 10 2005 016 862 A1 11/2005
EP 0 544 557 B1 10/1997

(Continued)

*Primary Examiner* — Bryon Gehman
(74) *Attorney, Agent, or Firm* — Kimberly-Clark Worldwide, Inc.

(57) ABSTRACT

The present disclosure is generally directed to a container and dispensing system, and more particularly to a refillable container that includes a container base having a partially open bottom, a refill cartridge disposed in the container base and covering at least a portion of the open bottom, and a lid. Providing a container base with a partially open bottom provides the user with an easy means of removing the refill cartridge, as the user may simply contact the refill cartridge through the bottom opening and push it upward through the open top of the container.

18 Claims, 5 Drawing Sheets

(56) References Cited

U.S. PATENT DOCUMENTS

| | | | | |
|---|---|---|---|---|
| D621,261 | S | 8/2010 | Demarco | |
| D621,708 | S | 8/2010 | Thomas et al. | |
| D624,419 | S | 9/2010 | Tivelli et al. | |
| D630,097 | S | 1/2011 | Brochado et al. | |
| D634,202 | S | 3/2011 | Zamberlan et al. | |
| D634,203 | S | 3/2011 | Mongeon et al. | |
| 7,992,740 | B2 * | 8/2011 | Kinchen | 220/200 |
| D645,750 | S | 9/2011 | Lee | |
| D659,004 | S | 5/2012 | McCoy | |
| D659,005 | S | 5/2012 | McCoy | |
| 2006/0186019 | A1 | 8/2006 | Lu | |
| 2008/0230436 | A1 * | 9/2008 | Martins et al. | 206/581 |
| 2010/0176131 | A1 | 7/2010 | Lopez Leon et al. | |
| 2013/0105476 | A1 * | 5/2013 | Hammer et al. | 220/23.83 |

FOREIGN PATENT DOCUMENTS

| | | | |
|---|---|---|---|
| EP | FR 2 796 044 | A1 | 1/2001 |
| EP | 2 030 907 | B1 | 5/2010 |
| EP | 2 392 224 | A1 | 12/2011 |
| EP | 2 397 047 | A1 | 12/2011 |
| WO | WO 03/056974 | A2 | 7/2003 |

* cited by examiner

REFILLABLE CONTAINER

BACKGROUND

Containers for storing and dispensing wiping substrates and particular wet wiping substrates are well known and widely available. Typically containers are designed to provide both storage and dispensing. Additionally, containers are often designed to be refillable such that a consumer purchases a durable container with their first purchase of wiping substrates and then subsequently purchases only refill packs. Typically the refill packs are simply a stack of substrates packaged in shrink wrap or an equivalent. To refill the container the consumer removes the packaging and inserts the stack of substrates into the container. This simplicity enables considerable cost savings to be passed on to the consumer. However, the consumer is required to handle the substrate directly, which may be unsatisfactory.

To avoid having the consumer directly contact the substrate when refilling, substrate refills may be provided in packaging that is inserted directly into the durable container for use. For example, refill packs may consist of flexible films produced in flowpack lines and filled with wiping substrates. The sack is sealed with a heat weld to form a refill pack. The user must orient the pack in the dispenser according to the printed instructions on the flowpack with the correct end of the pack facing the dispensing hole and then break the film to start the first wipe. Installing such refill packs by the user is somewhat difficult and often time-consuming, and the welded seams may be prone to leakage, particularly when housing premoistened wipes. Further, the refill packs often fit poorly in the container, particularly after a majority of the wipes have been dispensed. This poor fit may adversely affect dispensing and make it difficult for a user to remove the refill pack after it has been emptied.

Accordingly there is a need in the art for a refillable container, particularly a refillable container for storing and dispensing wiping substrates that is easy to refill, effectively dispenses and stores wipes, and is aesthetically pleasing.

SUMMARY

The present disclosure is generally directed to a container and dispensing system, and more particularly to a refillable container that includes a container base having a partially open bottom, a refill cartridge disposed in the container base and covering at least a portion of the partially open bottom, and a lid. Providing a container base with a partially open bottom provides the user with an easy means of removing the refill cartridge, as the user may simply contact the refill cartridge through the bottom opening and push it upward through the open top of the container.

Accordingly, in one embodiment the present invention provides a refillable container system comprising a base having a partial bottom terminating at a perimeter edge and defining a bottom opening, a continuous side wall extending up from the partial bottom and terminating at an upper end, a space within the side wall above the bottom, and an open top bounded by the upper end; a refill cartridge having a bottom, a continuous side wall extending up from the bottom and terminating at an upper end, a storage space within the side wall above the bottom, and an open top bounded by the upper end; and a lid having a main panel section, the lid configured to close off the open top of the container base near the upper end of the base side wall.

In another embodiment the present invention provides a refillable wiping substrate dispenser comprising a base having a partial bottom terminating at a perimeter edge and defining a bottom opening, a continuous side wall extending up from the partial bottom and terminating at an upper end, a space for receiving a refill cartridge within the side wall above the bottom, and an open top bounded by the upper end; a refill cartridge disposed within the base, the refill cartridge having a bottom, a continuous side wall extending up from the bottom and terminating at an upper end, a storage space for receiving a wiping substrate within the side wall above the bottom, and an open top bounded by the upper end; a wiping substrate disposed within the refill cartridge; and a lid having a main panel section, the lid configured to close off the open top of the base near the upper end of the base side wall.

In still another embodiment the present invention provides a refillable wiping substrate dispenser comprising a base having a partial bottom terminating at a perimeter edge and defining a bottom opening, a continuous side wall extending up from the partial bottom and terminating at an upper end, a space for receiving a refill cartridge within the side wall above the bottom, and an open top bounded by the upper end; a refill cartridge disposed within the base, the refill cartridge having a bottom, a continuous side wall extending up from the bottom and terminating at an upper end, a storage space for receiving a wiping substrate within the side wall above the bottom, and an open top bounded by the upper end, the refill cartridge contacting the base and covering the bottom opening; a wiping substrate disposed within the refill cartridge; and a closure comprising a base member having a peripheral skirt, a sealing member having a central opening and a cap, the closure configured to close off the open top of the base near the upper end of the base side wall.

DESCRIPTION OF THE DRAWINGS

Objects, features, and advantages of the present invention will become apparent upon reading the following description in conjunction with the drawing figures, in which.

DETAILED DESCRIPTION

The disclosed container and system solves or improves upon the problems with and disadvantages of currently known refillable storage and dispensing containers by providing a storage container system that includes a container base, a refill cartridge and a lid, where the cartridge is preferably rigid and easily removable from the container. The disclosed container base includes a partially open bottom that allows easy access to the bottom of the refill cartridge. This access allows a user to simply push the refill cartridge out from the bottom of the container through its open top. Additionally, the structure of the container system allows the container base, refill cartridge and lid to be combined in a stable, secure manner to prevent separation and to facilitate both storage and dispensing.

Accordingly, the present invention provides a refillable storage and dispensing container and a container system comprising a base, a refill cartridge, and a lid. The lid and base are preferably connected to one another, while the refill cartridge is removable from the system. The disclosed system comprises a base having a partial bottom, which results in the base having a bottom opening. The refill cartridge is employed to at least partially cover the open bottom when it is inserted into the container base. In addition to at least partially covering the open bottom of the base, the refill cartridge is preferably raised above the base bottom when inserted in the base. For example, in one particularly preferred embodiment the refill cartridge is elevated above the partial bottom of the container by resting on an upwardly extending lip that defines the opening in the bottom of the base. In other embodiments however, the refill cartridge bottom may contact the partial bottom and lie substantially in the same plane. The disclosed arrangement of refill cartridge and base allows for a user to easily remove the cartridge by reaching through the open base bottom and pressing on the bottom of the cartridge, lifting it upward and through the open top of the base. Also, in those embodiments where the refill cartridge is elevated above the base bottom any moisture that may collect in the base in use may be contained and kept away from the refill cartridge.

The refillable dispenser and storage system of the present invention is particularly well suited for dispensing and storing wiping substrates, including, but not limited to wipers, towels, and the like. Such substrates may be stacked, folded, interfolded, rolled, or in any format as are known for such substrates. The substrates may be either wet or dry.

Figure 1:
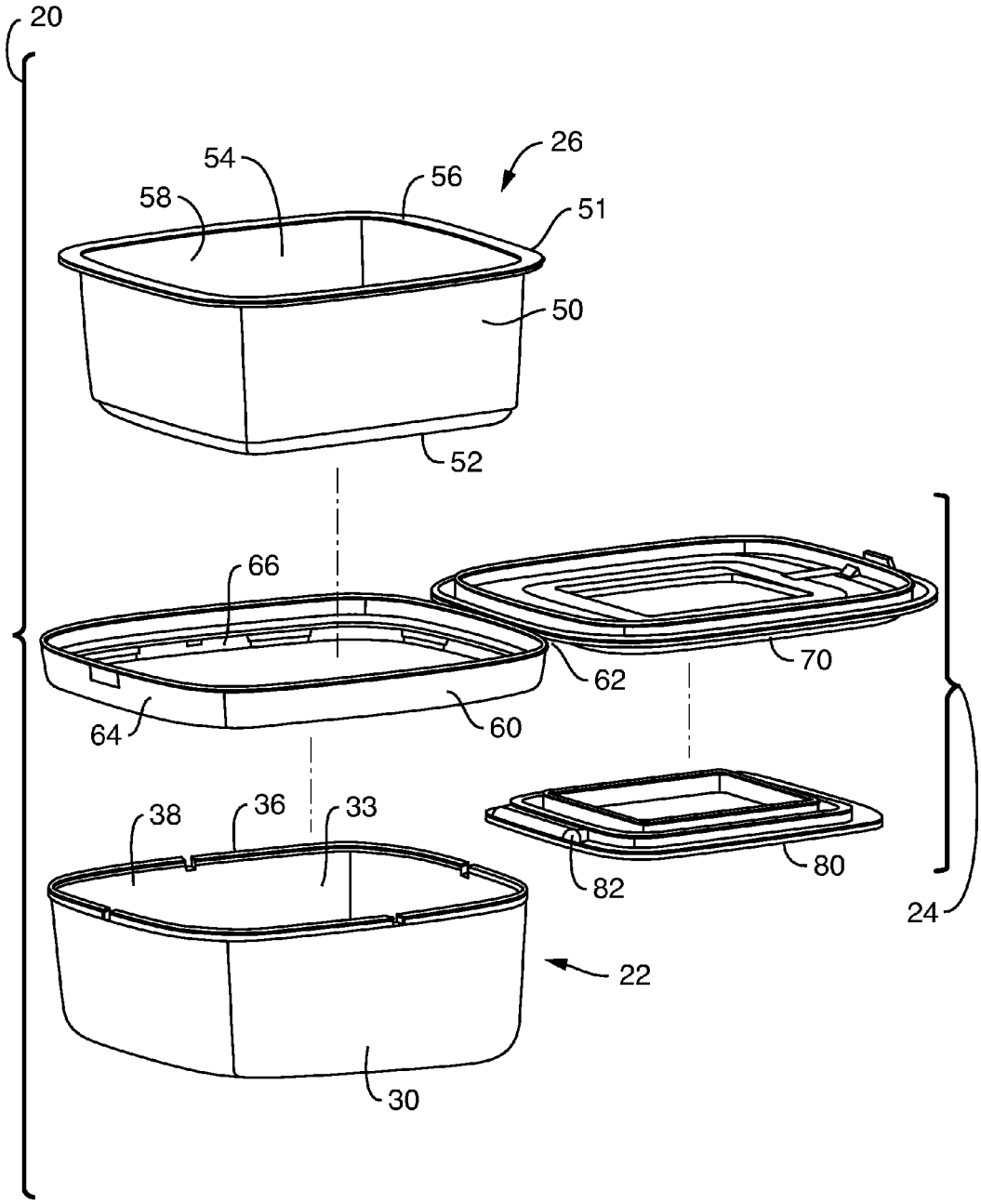
FIG. 1 shows refillable dispenser assembly according to one embodiment of the present invention.

Turning now to the drawings, FIG. 1 shows one example of a container assembly or container 20 constructed in accordance with the teachings of the present invention. The disclosed container generally has a base 22, a lid 24, and a refill cartridge 26, each to be described below in greater detail. The base 22, lid 24, and refill cartridge 26 of the container 20 are shown to be of a somewhat square-like (i.e., four-sided) or generally rectangular shape. However, other shapes and configurations of the base, cartridge and lid, such as round or circular, are contemplated and are intended to fall within the scope of the invention. The invention is not to be limited to a specific container base, cartridge, and lid perimeter shape or overall contour. In general, the refill cartridge 26 is sized to fit within the base 22 and the lid 24 is sized to fit over the base 22 during use.

With further reference to the figures, structural details of a representative base 22 are shown. The disclosed base 22 has a continuous circumferential side wall 30 and a partial bottom 32 and a bottom opening 34 that defines an interior storage space 33. In this example, the side wall 30 and the partial bottom 32 form a substantially four-sided shape, but with rounded corners, and a slight outward and upward taper to the side wall, as are known in the art. As noted above, other base shapes and configurations are contemplated and fall within the scope of the invention. The specific dimensions of the side wall 30 and the partial bottom 32 may vary and yet remain within the scope of the invention as well. The side wall 30 extends upwardly and generally outwardly from a perimeter of the partial bottom 32 and terminates at a top edge 36 that defines an open top 38. The open top 38 of the base 22 in this example can be identical in size and shape, regardless of interior volume.

The partial bottom 32 is formed as an extension of the side wall 30 and terminates at an edge 35 interior thereto. The peripheral edge 35 defines the perimeter 37 of the open bottom 34 portion of the base 22. The size of the open bottom 34 may vary depending on the size of the refill cartridge 26, however, the area of the open bottom 34 is generally less than the area of the open top 38. In certain preferred embodiments the open bottom 34 is slightly smaller than the refill cartridge bottom 52 so that when the refill cartridge 26 is inserted into the base 22 the refill cartridge bottom 52 completely covers the open bottom 34.

Figure 4:
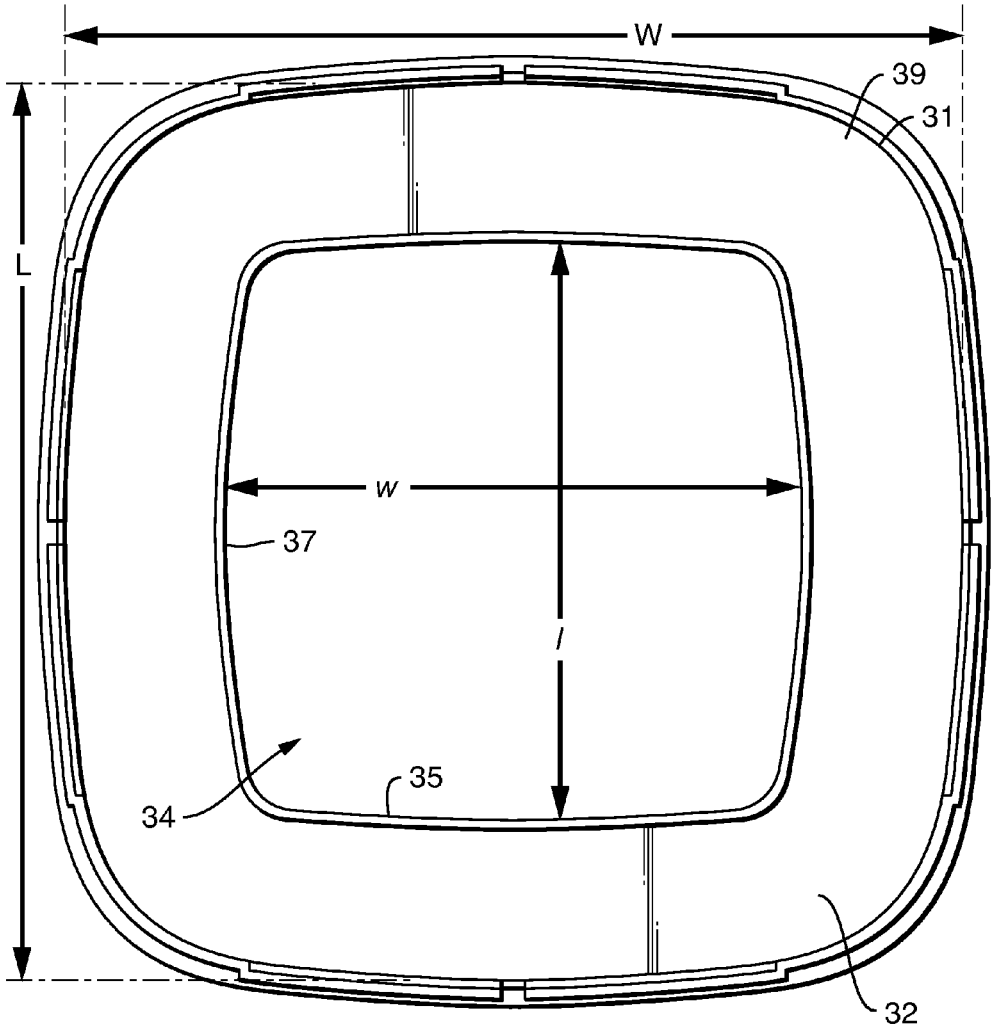
FIG. 4 shows a bottom view of refillable dispenser according to one embodiment of the present invention.
Figure 5:
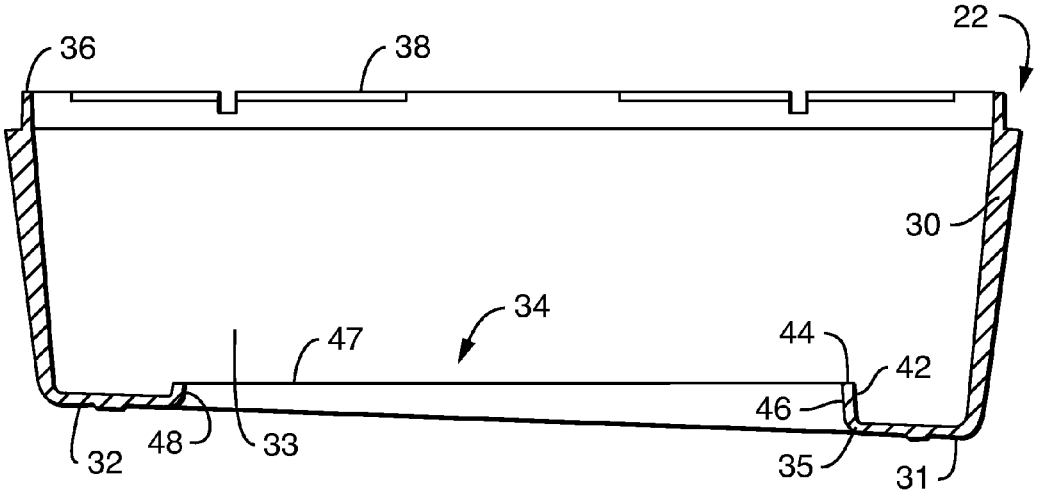
FIG. 5 shows a cross section view of an open bottom container according one embodiment of the present invention.

In other embodiments the area of the open bottom 34 preferably comprises at least about 50 percent of the total area of the base bottom (measured as the surface area interior to the perimeter 39 created by the lower terminal edge 31 of the continuous circumferential side wall 30). In a particularly preferred embodiment the area of the bottom opening 34 comprises from about 50 to about 85 percent and still more preferably from about 65 to about 75 percent of the total area of the base bottom. Accordingly, with reference to FIG. 4, in certain preferred embodiments, the opening 34 is substantially rectangular and has a width (w) and a length (l), while the base bottom is also substantially rectangular and has a width (W) and a length (L). In certain embodiments the width (w) of the bottom opening 34 may be from about 60 to about 100 mm and the length (l) may be from about 60 to about 100 mm, while the width (W) of the base bottom may be from about 100 to about 130 mm and the length (L) may be from about 100 to about 130 mm.

In a particularly preferred embodiment the base 22 also has a rib 42 that extends upward from the partial bottom 32 of the base towards the open top 38. The rib 42 in this example is a continuous rib on the partial bottom 32, but can alternatively be formed as a plurality of individual, discrete feet or ribs extending upward from the partial bottom 32. The disclosed rib 42 extends circumferentially around the partial bottom 32 and is spaced inward from the side wall 30. The size, positioning, and shape of the rib can vary from the example shown and yet function as intended. The rib 42, and more preferably the upper edge 44, provides a resting surface on which the refill cartridge 26 can rest when it is inserted into the base 22.

Figure 3:
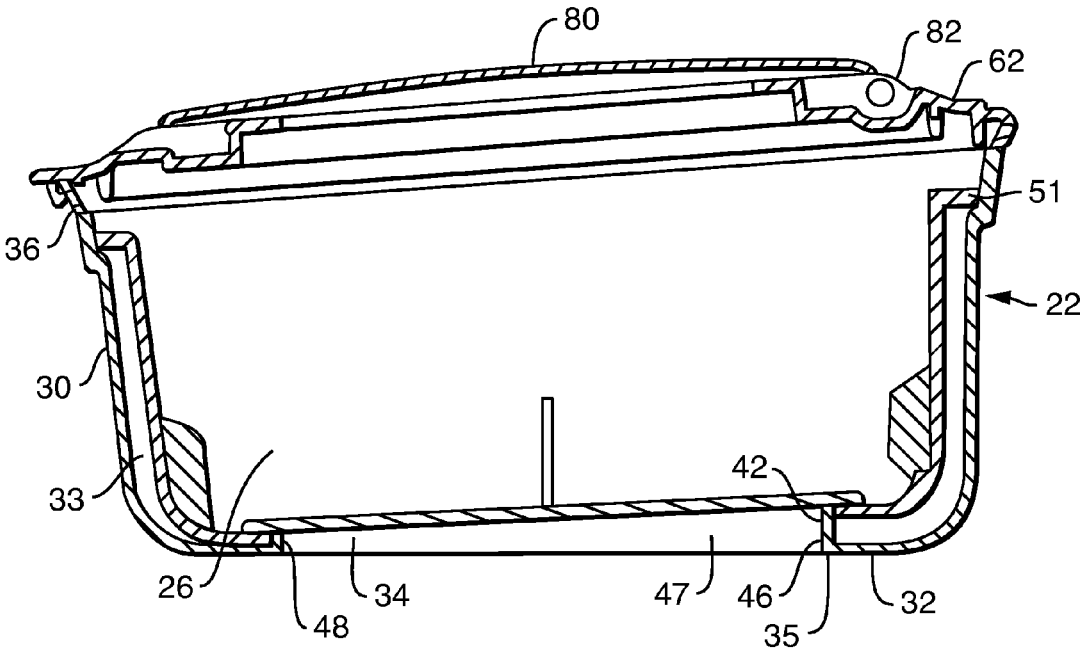
FIG. 3 shows a cross sectional view of the dispenser of FIG. 2, through line A-A.

In the embodiment illustrated in detail in FIG. 3, the rib 42 has an additional function of supporting the refill cartridge 26 at a desirable dispensing angle. As illustrated in FIG. 3, the rear edge 46 of the rib 42 has a greater vertical height than the front edge 48. The front 48 and rear 46 edges of the rib 42 are connected by downward tapering side edges 47. In this manner, when the refill cartridge 26 rests on the rib 42 the cartridge is angled downward towards the front of the container.

In other embodiments the base also has a foot or rib that extends downward from the bottom of the base (not illustrated). The foot is preferably a continuous rib on the base bottom, but can alternatively be formed as a plurality of individual, discrete feet or ribs extending downward from the bottom. The disclosed foot extends circumferentially around the bottom and is spaced inward from the side wall. The size, positioning, and shape of the foot can vary and yet function as intended. The foot provides a resting surface on which the container or base can rest during use and while being stored.

The base 22 in the disclosed example can be formed of virtually any suitable material and using likewise suitable manufacturing processes. In one example, the base 22 can be injection molded from a polycarbonate material resulting in a substantially rigid and sturdy structure that is washable and highly durable. The base material can be clear, translucent, semi-transparent, or opaque as well.

With reference to FIG. 1, the refill cartridge 26 in this example has a continuous circumferential side wall 50 and a bottom 52 that defines an interior storage space 54. In this example, the side wall 50 and the bottom 52 form a substantially four-sided shape, but with rounded corners, and a slight outward and upward taper to the side wall, as are known in the art. As noted above, other base shapes and configurations are contemplated and fall within the scope of the invention. The specific dimensions of the side wall 50 and bottom 52 may vary and yet remain within the scope of the invention as well. The side wall 50 extends upwardly and generally outwardly from a perimeter of the bottom 52 and terminates at a top edge 56 that defines an open top 58.

As best illustrated in FIG. 1, the refill cartridge bottom 52 is surrounded by a side wall 50 extending up from the bottom 52 and terminating at a top edge 56. In a particularly preferred embodiment a rim 51 extends radially outward from the top edge 56. In certain embodiments the rim 51 extends outward such that when the refill cartridge 26 is inserted into the base 22 the rim 51 extends to the top edge 36 of the base side wall 50. In other embodiments the base may include a lip extending substantially perpendicular to the sidewall and positioned just below the top edge (not illustrated). The lip may extend partially, or entirely, about the circumference of the upper opening of the base. The lip is preferably directed inwards to the central open portion and contacts the refill cartridge rim when the cartridge is inserted into the base. In this manner, when the cartridge is inserted into the base the rim extends over at least a portion of the lip and is supported thereby.

FIG. 3 shows a cross sectional view of base 22 having a refill cartridge 26 in place. The cartridge bottom 52 contacts the base rib 42 such that the bottom 52 sealingly engages the base 22 to form a dispensing system having a bottom. In other embodiments a seal may be formed around the upper end of the base when the cartridge is positioned in the base and the cartridge rim rests upon a lip at the upper edge of the base. In this manner the dispensing system may be formed such that the refill cartridge and base may be combined into a system that prevents the ingress of water into the container from both the top and bottom and maintains contents of the refill cartridge in either a dry or wet state.

As with the base 22, the refill cartridge 26 can be formed of any suitable material and fabricated from any likewise suitable manufacturing process. In one example, the refill cartridge 26 can be injection molded from a polypropylene material, a polycarbonate material, or the like. In addition, the refill cartridge 26 can also be formed from a clear, translucent, semi-transparent, or opaque material and can be formed in any desirable color. In one example, the refill cartridge 26 can be formed of a colored material so as to make the refill cartridge 26 easy for a consumer to locate.

In a particularly preferred embodiment the refill cartridge 26 comprises an injection molded polypropylene base and a peelable lid affixed thereto with an adhesive. A dry or wet wiping substrate is provided in the refill unit. When a user is ready to replace an existing cartridge, the user begins by reaching through the bottom opening to reach the cartridge bottom and pressing upward to remove the cartridge from the base. The user then removes the peelable lid from a new refill cartridge and places the refill cartridge in the base.

With reference again to FIG. 3, the bottom 52 of the refill cartridge 26 in this example coincides with the generally four-sided rib 42 of the base 22. Thus, when the refill cartridge 26 is disposed in the base 22, the bottom 52 contacts the rib 42 continuously about its perimeter. The rib 42 elevates the refill cartridge 26 a sufficient height so as to raise the refill cartridge 26 above the partial bottom 32 in use. The rib 42 is positioned around the circumference of the cartridge near its perimeter edge to provide stability during use. Thus, inclusion of the rib 42 allows for the refill cartridge 26 to be sized to fit closely within base 30 and form a substantially closed container when installed.

The refill cartridge sidewall 50 is preferably spaced apart from the base side wall 30. In the disclosed example, the refill cartridge 26 and the base 22 are joined with one another along the circumference of the rib 42. The refill cartridge is angled downwards towards the front sidewall of the container to allow drainage of any moisture that collects inside the cartridge and to aid in dispensing of a substrate stored therein.

In general, the bottom 52 of the refill cartridge 26 is accessible via the open bottom 34 of the base 22. In this example, the cartridge bottom 52 covers the open bottom 34 entirely. By covering the open bottom 34 when inserted into base 22, the combination of the refill cartridge 26 and the base 22 forms a dispensing container having four side walls and a complete bottom. Although it is preferred that the refill cartridge bottom 52 cover the open bottom 34 entirely, the arrangement, location and shape of the cartridge bottom relative to the open base bottom can vary widely from the example shown and yet function as intended. Thus, in alternate embodiments the refill cartridge bottom may only partially cover the open bottom.

As best illustrated in FIG. 3, the refill cartridge bottom 52 is elevated above the partial bottom 32 of the base 22 and accessible via the partially open bottom. The partially open bottom 34 makes it easy for a user to access and remove the refill cartridge 26 from within the base 22 by simply pressing her fingers against the refill cartridge bottom 52 and forcing it out through the base opening 34. Thus, in this manner the user may remove the refill cartridge without tipping the base over. Further, the cartridge may be removed without the aid of additional features such as a lip about its open end or a tab. An additional advantage is that the open bottom may permit the passage of air into the container easing the removal of a cartridge having minimal axial spacing between the refill cartridge walls and the base side walls.

In certain embodiments the container system 20 disclosed and described herein may be provided with a connecting structure for connecting the base 22, lid 24, or refill cartridge 26 with one another in a number of optional arrangements. In one aspect of the invention, the refill cartridge disclosed herein is provided with a plurality of elongated lips or projections that extend radially outward from the refill cartridge wall. For example, in one embodiment each of the four sides of the refill cartridge includes a projection centrally located on each side of the refill cartridge wall. The base may include a groove aligned with the corresponding projection such that when the refill cartridge is inserted into the base, the combination of the projections and grooves combine to support and interconnect the parts.

Now turning to the lid, which is preferably configured to overlay and close off the open base top near the upper end of the base side wall. Accordingly, it is preferred that the lid is formed with features that allow it to cover and seal the open top of the base. In one embodiment the lid may comprise a main panel with a top side, a bottom side, and a perimeter skirt. The skirt circumvents the perimeter of the main panel and more preferably extends around the main panel and generally perpendicularly down from the plane of the main panel. In a particularly preferred embodiment the skirt wall is positioned inward from an outer edge of the main panel resulting in a lid rim projecting radially outward from the lid beyond the skirt wall.

The lid may be operatively connected to the base, or in other embodiments may be removably connected. In those embodiments where the lid is operatively connected to the base, the lid is preferably connected to the base by a hinge. The hinge can be a "living hinge", a "pivoting hinge", or another type of hinge. A living hinge is a hinge formed with the base and the lid as a single piece. A living hinge can be configured to facilitate the lid being able to spring away from the base when the closure system is to be opened. A pivoting hinge is formed at substantially the same time as the body portion (or the lid portion), wherein the body portion and the lid portion are formed as separate pieces and snapped together at the hinge to combine the two pieces into a single container assembly.

The hinge provides ease of moving the lid. For example, the hinge operatively connects the lid to the base in a movable arrangement, wherein the lid comprises at least two positions, namely, a first position and a second position. When in the first position, the lid is "open" (or moved away from the base), which allows product (e.g., a wiping substrate) to be dispensed from the refill cartridge. When the lid is in the second position, the lid is closed or engaged with the base providing a secure seal according to various embodiments disclosed herein. Thus, the hinge allows the lid to be moved away from the base for dispensing and/or for filling, as well as moved into contact with the base for storage or transport purposes.

In certain embodiments the lid is not connected to the base with a hinge, but rather the lid fits onto base by fitting the skirt wall over the base's top edge. In this in-use configuration, the lid would cover and close off the open top to seal the storage space. In a particularly preferred embodiment, the skirt wall has a gradually thicker portion that is shaped to form an annular seal ridge. The ridge extends radially inward and circumferentially around the inner surface of the skirt wall. The top edge of the base side wall can have a bead thereon, if desired, to further bear against an inner surface of the skirt wall with the lid installed on the base. The lid may be drawn downward by the geometry of the upper portion and the ridge to assist in retaining the lid installed on the base.

In other embodiments the lid is operatively connected to the base by a hinge and is formed with the base as a one-piece construction rather than as a plurality of parts separately attached together. In this manner the lid and base are joined by a living hinge.

In a particularly preferred embodiment, such as that illustrated in FIG. 1, the lid 24 comprises a lid base member 60, a sealing member 70 and a cap 80. Preferably in the closed position shown in FIG. 2, the lid base member 60, sealing member 70 and cap 80 are in cooperative engagement to form a closure 24. The components are attached to one another by hinges so as to enable their opening and closing. Preferably the sealing member 70 is attached to the base member 60 by a living hinge 62, while the cap 80 is attached to the sealing member 70 by a snap hinge 82.

The lid base member 60 preferably comprises a cylindrical skirt 64 and is preferably connected to the sealing member 70 by a living hinge 62. In this manner, the skirt 64, hinge 62 and sealing member 70 are integrally formed. The lid base member 60 and base 22 are assembled together to form closure 24 by positioning the lid base skirt 64 over the upper edge of the base 36. The lid base skirt 64 may be provided with ribs 66 and the base edge with knurls or splines (not illustrated) to rigidly secure the skirt 64 to the base 22. When base member 60 is assembled upon the base 22 by positioning of base skirt 64 upon upper edge of the base 36 the sealing member 70 is movable between its closed position and its open position by pivoting the sealing member 70 about hinge 62.

The sealing member 70 further comprises an opening 72 that is preferably covered by a cap 80. The opening 72 may act as a dispensing orifice through which the product can be dispensed when the cap 80 is opened. The cap 80 is removably positionable to be closed to engage the sealing member and thereby seal the container at the outer surface where the removable portion is surrounded by the lid. The cap 80 can include an annular sealing ring extending downwardly away from the inside of the lid and which is sized to fit against an annular sealing ring extending upwardly away from the inside of the sealing member to thereby assist in better sealing the cap to the sealing member when the cap is closed.

In other embodiments the cap can include a latch with an elongate first rib projecting horizontally therefrom, and the sealing member can include a catch with an elongate second rib projecting horizontally therefrom. The first and second ribs can removably engage each other in an interference fit to maintain the cap in a closed position and removably disengage each other when the cap is opened.

Figure 2:
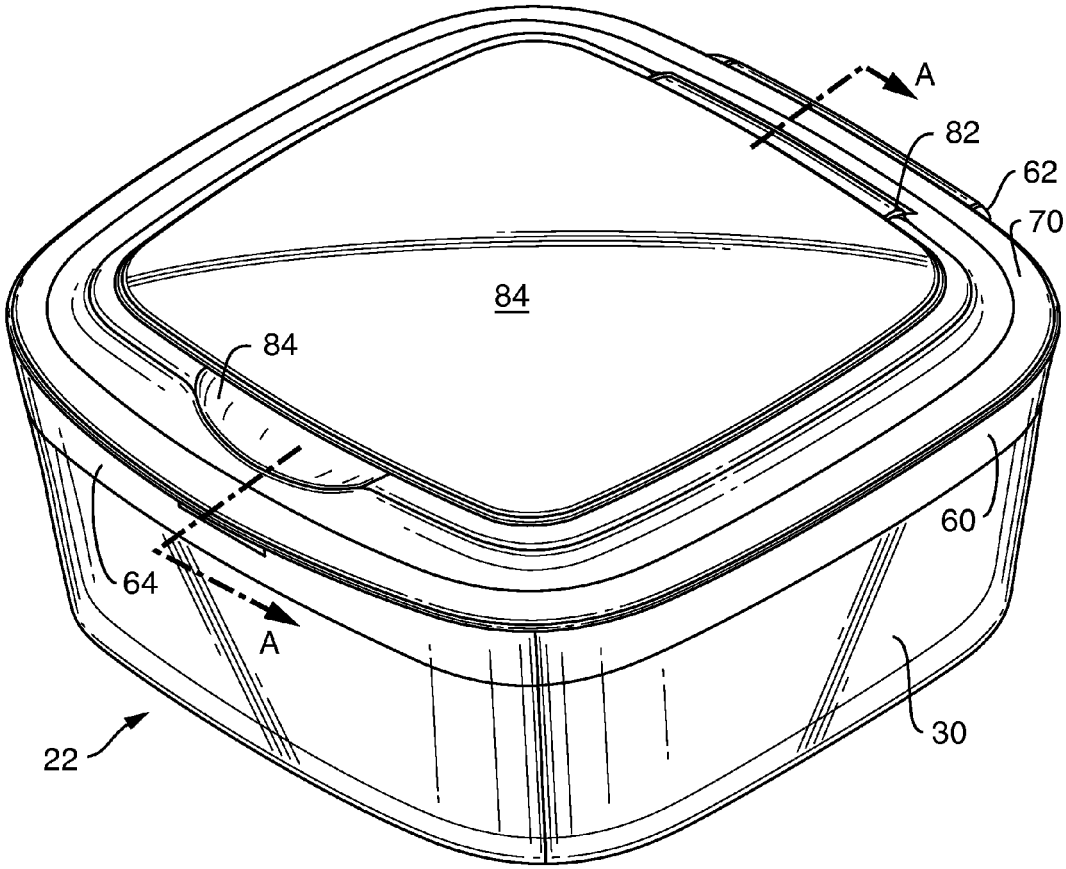
FIG. 2 shows a refillable dispenser according to one embodiment of the present invention.

In other embodiments the cap 84 may further comprise an opening tab 84, see for example, FIG. 2. The opening tab is defined herein as any portion of the cap that enables a user to place at least their fingertip(s) between the tab portion and the sealing member to assist in separating the cap from the sealing member when moving the cap to the open position. The opening tab may either be formed as a protrusion from the cap or as an indentation in the sealing member, as illustrated in FIG. 2 so that a user can more easily locate the tab and have a more identifiable leverage point to open the cap.

As with the base and refill cartridge, the lid can also be formed of any suitable material and fabricated from any likewise suitable manufacturing process. In one example, the lid can be injection molded from a polypropylene material, a polyethylene material, or the like. In addition, the lid can also be formed from a clear, translucent, semi-transparent, or opaque material and can be formed in any desirable color.

We claim:

1. A refillable container system comprising:

a. a base having a partial bottom terminating at an inner perimeter edge defining a bottom opening, at least one rib extending upward from and defining at least in part the inner perimeter edge, a continuous side wall extending up from the partial bottom and terminating at an upper end, a space within the side wall above the partial bottom, and an open top bounded by the upper end;

b. a refill cartridge having a bottom, a continuous side wall extending up from the cartridge bottom and terminating at an upper end, a space within the side wall above the cartridge bottom, and an open top bounded by the upper end; and c. a lid configured to close off the open top of the base near the upper end of the base side wall.

2. The refillable container system of claim 1 further comprising a wiping substrate disposed in the refill cartridge.

3. The refillable container system of claim 1 further comprising a hinge operatively connecting the base and the lid.

4. The refillable container system of claim 1 wherein the refill cartridge bottom is sized to completely cover the bottom opening of the base.

5. The refillable container system of claim 1 wherein the refill cartridge contacts the at least one rib.

6. The refillable container system of claim 1 wherein the rib extends continuously around the inner perimeter edge of the partial bottom.

7. The refillable container system of claim 1 wherein the at least one rib has a front, a back and a pair of opposed side edges, wherein the height of the back edge is greater than the height of the front edge.

8. The refillable container system of claim 1 wherein the refill cartridge has a rim extending from the upper end and substantially perpendicular to the side wall.

9. A refillable wiping substrate dispenser:

a. a base having a partial bottom terminating at an inner perimeter edge defining a bottom opening, at least one rib extending upward from and defining at least in part the inner perimeter edge, a continuous side wall extending up from the partial bottom and terminating at an upper end, a space for receiving a refill cartridge within the side wall above the partial bottom, and an open top bounded by the upper end;

b. a refill cartridge disposed within the base, the refill cartridge having a bottom, a continuous side wall extending up from the cartridge bottom and terminating at an upper end, a storage space for receiving a wiping substrate within the side wall above the cartridge bottom, and an open top bounded by the upper end;

c. a wiping substrate disposed within the refill cartridge; and d. a lid configured to close off the open top of the base near the upper end of the base side wall.

10. The refillable wiping substrate dispenser of claim 9 wherein the refill cartridge bottom is sized to completely cover the bottom opening of the base.

11. The refillable wiping substrate dispenser of claim 9 wherein the bottom opening comprises from about 50 to about 90 percent of the total bottom area of the base.

12. The refillable wiping substrate dispenser of claim 9 wherein the at least one rib extends continuously around the inner perimeter edge of the partial bottom.

13. The refillable wiping substrate dispenser of claim 9 wherein the refill cartridge has a rim extending from the upper end and substantially perpendicular to the side wall, the rim contacting the base.

14. A refillable wiping substrate dispenser:

a. a base having a partial bottom terminating at an inner perimeter edge defining a bottom opening, at least one rib extending upward from and defining at least in part the inner perimeter edge, a continuous side wall extending up from the partial bottom and terminating at an upper end, a space for receiving a refill cartridge within the side wall above the partial bottom, and an open top bounded by the upper end;

b. a refill cartridge disposed within the base, the refill cartridge having a bottom, a continuous side wall extending up from the cartridge bottom and terminating at an upper end, a storage space for receiving a wiping substrate within the side wall above the cartridge bottom, and an open top bounded by the upper end, the refill cartridge contacting the base and covering the bottom opening;

c. a wiping substrate disposed within the refill cartridge; and d. a closure comprising a base member having a peripheral skirt, a sealing member having a central opening and a cap, the closure configured to close off the open top of the base near the upper end of the base side wall.

15. The refillable wiping substrate dispenser of claim 14 wherein the refill cartridge bottom is sized to completely cover the bottom opening of the base.

16. The refillable wiping substrate dispenser of claim 14 wherein the sealing member is operatively connected to the base member by a hinge and the sealing member is connected to the cap by a hinge.

17. The refillable container system of claim 14 wherein the at least one rib extends continuously around the inner perimeter edge of the partial bottom.

18. The refillable container system of claim 14 wherein the at least one rib has a front, a back and a pair of opposed side edges, wherein the height of the back edge is greater than the height of the front edge.

* * * * *